US005517812A

United States Patent [19]

Simmons

[11] Patent Number: 5,517,812

[45] Date of Patent: May 21, 1996

[54] AUTOMATIC CONTROL OF ARMOUR TAPE TENSION

[75] Inventor: Frederick Simmons, Fergus, Canada

[73] Assignee: Alcatel Canada Wire, Inc., Ontario, Canada

[21] Appl. No.: 342,693

[22] Filed: Nov. 21, 1994

[30] Foreign Application Priority Data

Nov. 22, 1993 [CA] Canada ..... 2109668

[51] Int. Cl.[6] ..... D02G 3/36; D02G 3/06

[52] U.S. Cl. ..... 57/18; 57/3; 57/58.83; 57/93; 57/212; 57/235; 57/264; 242/420.5; 242/441.4

[58] Field of Search ..... 57/3, 10, 11, 12, 57/18, 212, 210, 235, 264, 58.86, 58.83, 93; 242/7.22, 420, 420.5

[56] References Cited

U.S. PATENT DOCUMENTS

| | | | |
|---|---|---|---|
| 3,381,459 | 5/1968 | Vawter | 57/264 |
| 3,756,004 | 9/1973 | Gore | 57/3 |
| 4,392,342 | 7/1983 | Meijer | 57/93 |
| 4,470,248 | 9/1984 | Nortenius | 57/18 |
| 4,628,675 | 12/1986 | Sakamoto | 57/264 |
| 4,653,153 | 3/1987 | Felix et al. | 57/93 |
| 4,663,928 | 5/1987 | Delobel et al. | 57/264 |
| 4,888,944 | 12/1989 | Felix | 57/264 |
| 5,441,213 | 8/1995 | Graham | 242/534.2 |

FOREIGN PATENT DOCUMENTS

| | | | |
|---|---|---|---|
| 204281 | 8/1990 | Japan | 57/11 |

*Primary Examiner*—William Stryjewski
*Attorney, Agent, or Firm*—Ware, Fressola, Van Der Sluys & Adolphson

[57] ABSTRACT

A method and system are provided for automatically controlling tension of an armour tape being wrapped around a continuous strand of material, such as an electrical cable, travelling through an armouring machine having a reel of tape and tape feed rolls rotating around the strand and having a motor or suitable variable speed drive (such as a P.I.V. variable speed drive) for controlling the speed of rotation of the tape feed rolls and thus of tape feed rate. To achieve automatic control, the diameter of the strand entering the machine is measured, preferably by a laser, and the diameter of the armour over the strand exiting the machine is also measured, also preferably by a laser. The measurements are communicated to a computer which compares them to preset values. The computer drives the motor or variable speed drive and adjusts them when required depending on the measurements of the two diameters and so as to maintain the preset values during the wrapping operation.

7 Claims, 1 Drawing Sheet

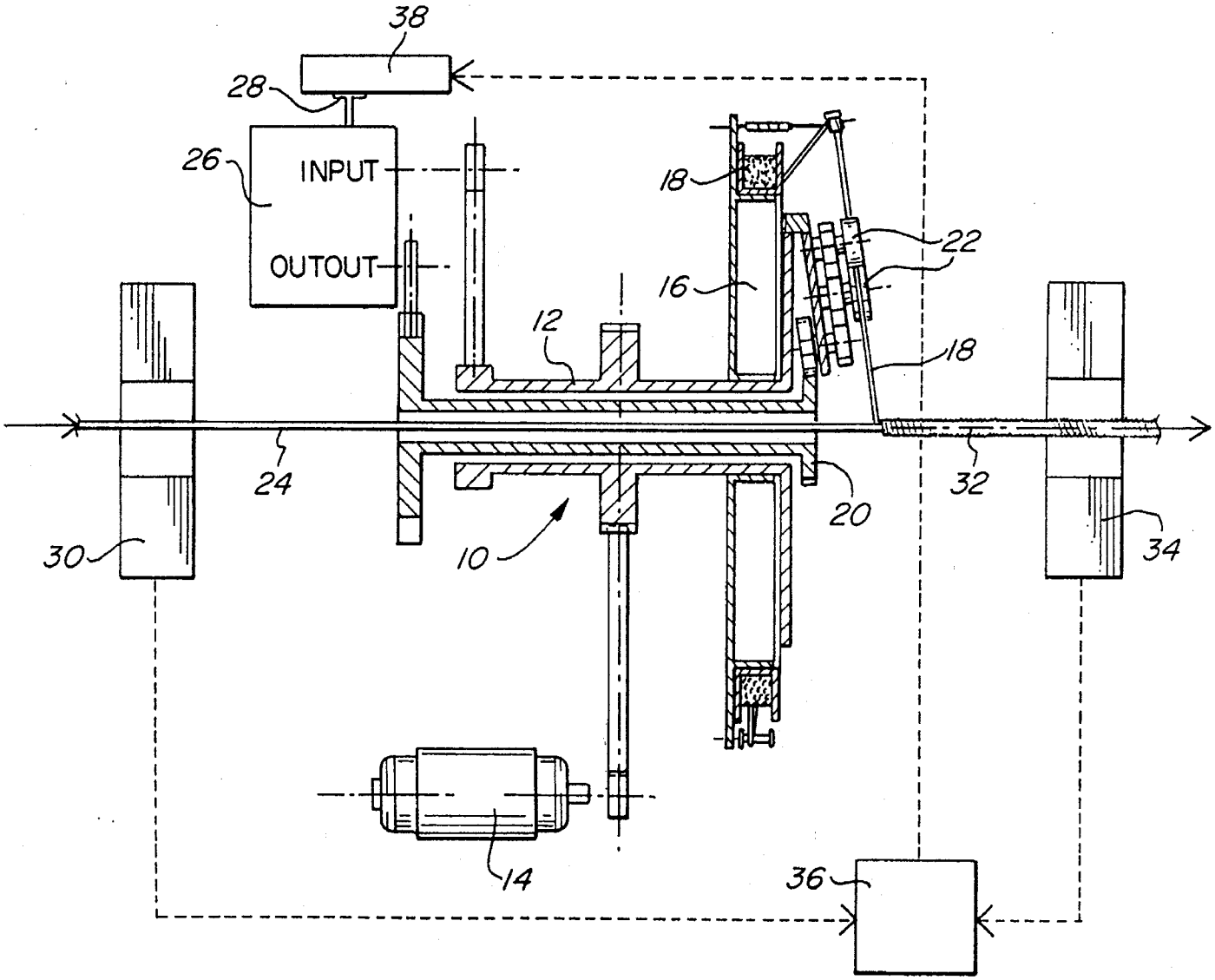
34
32
22
18
20
36
18
16
12
10
14
38
INPUT
OUTOUT
28
26
24
30

AUTOMATIC CONTROL OF ARMOUR TAPE TENSION

BACKGROUND OF THE INVENTION

1. Field of the Invention

This invention relates to an automatic control of armour tape tension, particularly when wrapping metal tape around electrical cables for mechanical protection. More particularly, the invention relates to a method and a system for continuously and automatically controlling such armour tape tension during the wrapping operation.

2. Description of the Prior Art

Wrapping of tapes around continuously moving objects, in particular the wrapping of metal tapes around electrical cables is accomplished by continuous armouring machines, such as those known as "BX" machines, which are designed to wrap the tape around the cable from a reel on a spindle which rotates around the cable at high rpm (e.g. in the range of 1000 rpm).

The machine is provided with tape feed rolls which must be set up so that the tape forms a tube around the cable which neither cuts the cable nor allows it to be too loose within the armour. To control this tube, the machine uses a P.I.V. variable speed drive (P.I.V. standing for "PROPORTIONAL INFINITELY VARIABLE" transmission), which pushes the tape out by means of the feed rolls to be wrapped around the cable. Such P.I.V. drives are available on the market; for example, there is one sold under the trademark LINK BELT® by FMC Corporation. By adjusting the ratio of push to rotational speed, the size of the tube can be controlled. Instead of the P.I.V., two motors with two drives can also be used.

Presently, to control the size or tightness of the tube, the operator manually adjusts the P.I.V. using a hand wheel or the speed control of drives on the motors using a potentiometer. These control methods, however, are unsatisfactory since once the run has started, the operator cannot check the tightness of the armour on the cable and, as a result, cables are often damaged by tight armour or rejected for loose armour.

It should be mentioned, in this regard, that there are fairly strict UL (Underwriters Laboratories) standards for metal-clad cables, which require that "Interlocked, corrugated, or smooth armour on a cable containing any No. 4 AWG or larger insulated conductor(s) shall grip the cable to keep the conductor assembly from being withdrawn from a sample 10 ft or 3 m long by the application of a pull of 30 lbf or 133N or 13.6 kgf". At the same time, of course, the tape should not be so tightly wrapped as to cut into the cable.

SUMMARY OF THE INVENTION

An object of the present invention is, therefore, to provide an automatic control of the armour tape tension as it is wrapped, so as to satisfy the above mentioned requirements and to produce consistent quality performance of the product.

Another object is to provide a system whereby the tape feed rolls would adjust automatically to maintain constant tension of the tape around the cable.

Other objects and advantages of the invention will be apparent from the following description thereof.

Thus, the invention comprises a method of automatically controlling tension of an armour tape being wrapped around a continuous strand of material, such as an electrical cable or cable core, travelling through an armouring machine having a reel of tape and tape feed rolls rotating around the strand and having means for controlling the speed of rotation of the tape feed rolls and thus of tape feed rate, which comprises: continuously measuring the diameter of the strand entering the machine and the diameter of the armour over the strand exiting the machine; comparing the resulting measurements against preset values by means of a computer; and operating by the computer the means controlling the speed of rotation of the tape feed rolls, thereby automatically adjusting the feed rate of the tape when required, so as to maintain said preset values during the wrapping operation.

The invention also includes a system for automatically controlling tension of an armour tape being wrapped around a continuous strand of material, such as an electrical cable, travelling through a machine having a reel of tape and tape feed rolls rotating around said strand and having means for controlling the speed of rotation of the tape feed rolls and thus tape feed rate, comprising: means for measuring the diameter of the strand at a point of entry to the machine; means for measuring the diameter of the armour over the strand at a point of exit from the machine; a computer responsive to the output of said measurements and to corresponding preset values stored in its memory for operating said means controlling the speed of rotation of the tape feed rolls, said computer automatically adjusting the feed rate of the tape when required so as to maintain said preset values during operation of the machine.

The continuous strand of material is normally an electrical cable, or cable core, usually consisting at least of a conductor and an insulating jacket, which is then wrapped with metal tape for mechanical protection by passing it through an armouring machine such as a "BX" machine. The prior jacketing and cabling operations are usually remote from the tape wrapping operation and the cable resulting from such prior operations may have variations in its diameter which are detected by the first measurement of the input cable diameter entering the armouring machine. Then, at the exit from the machine, the diameter of the armour on the cable is again measured. Although there are various ways that could be used to measure a diameter of a moving object, such as by the use of a source of radiation, by optronic sensors and the like, it has been found that for the purposes of the present invention, the preferred manner is by means of lasers. Such lasers are, for example, supplied by BETA Corporation under the name "Envelope Measurement System".

The information from the above measurements is transmitted to a computer which compares it with preset values in its memory. The computer operates the means which control the speed of rotation of the tape feed rolls on the machine and will automatically adjust the tension of the tape and thus its feed rate so as to take into account any variations in the two diameters measured by the lasers and continuously and automatically adjust them to the preset values contained in its memory. In this manner a product of consistent quality is produced which will pass the UL pull out test and the load test consistently, with reduced material give away and reduced scrap.

The armouring machines, such as the BX machine, are available on the market from suppliers such as Ceeco Limited or Cancab Corporation. Such machines contain means that control the speed of rotation of the tape feed rolls and which consist of P.I.V. variable speed drives or of motors using, for example, two DC drives that can be adjusted to control the tension of the armour tape being wound on the cable.

The invention will now be described with reference to the appended drawing showing a figure which illustrates the present invention using a partial section view and which is the only figure herein.

BRIEF DESCRIPTION OF THE DRAWINGS

The sole Figure is a cross-sectional view of an armouring machine having automatic control of armour tape tension in accordance with the present invention.

BEST MODE FOR CARRYING OUT THE INVENTION

In the figure the armouring machine 10 is illustrated in section view. It's main spindle 12 is rotatable by motor 14 at a high rpm. A reel 16 with armour tape 18 is mounted on the spindle 12 for rotation therewith. Head 20 of the machine supports tape feed rolls 22 and is also rotatable around cable 24 in the same direction as the spindle 12. P.I.V. or motor 26 is used to control the feed rate of tape 18 as it is wrapped around cable 24. A wheel or handle 28 is used to adjust the ratio of the P.I.V. or motor input and output drives to control the tension of tape 18. By controlling the P.I.V. ratio, the tension and thus the rate of advance of tape 18 by feed rolls 22 is either increased or decreased. The known practice is for the operator to adjust this ratio manually using the hand wheel 28.

According to the present invention, the diameter of cable 24 is continuously measured by laser 30 just as the cable enters the machine 10. As armour tape 18 is wrapped around cable 24 by the machine, it produces armoured cable 32. At the exit from the machine, the diameter of the armoured cable 32 is measured by laser 34. The measurements made by lasers 30 and 34 are transmitted to computer 36 which compares them with preset values in its memory that were pre-programmed for this particular cable armouring operation and which depend on the size of the cable, speed of feeding the cable into the machine, etc.

Computer 36 operates a gear motor 38 and automatically adjusts the P.I.V. or motor 26 ratio depending on the measurements fed by laser 30 and 34 and their comparison with the preset values. The computer will make the required adjustments automatically so as to maintain the preset values during the entire wrapping operation by adjusting the rate of input and output gear of the P.I.V. or motor 26 trough gear motor 38 and handle 28 and thus automatically controlling the tension of the armour tape 18. This, in turn, will adjust the feed rate of tape 18 which is being wrapped around cable 24. For example, increasing the rate of feed of tape 18 increases the amount of interlock and thus the diameter of armoured cable 32 and vice versa, if the tape rate is reduced the diameter of armoured cable 32 will be reduced due to lesser interlock of the tape. In the event of changes in diameter measurements by lasers 30 and/or 34, the computer 36 will automatically make stepped adjustments until the preset values are again achieved. This is done on a continuous basis, without stopping the machine and results in more consistent product diameter of armoured cable 32 as well as consistent quality of the product.

The invention has been described above with reference to a preferred embodiment thereof and many modifications obvious to a person skilled in the art can be made without departing from the spirit of the invention and the scope of the following claims.

What is Claimed is:

1. Method of automatically controlling tension of an armour tape being wrapped around a continuous strand of material travelling through an armouring machine having a reel of tape and tape feed rolls rotating around said strand and having means for controlling the speed of rotation of the tape feed rolls for thereby controlling the tape feed rate, which comprises: continuously measuring the diameter of the strand entering the machine and the diameter of the armour over the strand exiting the machine; comparing the resulting measurements against preset values by means of a computer; and operating by the computer said means controlling the speed of rotation of the tape feed rolls, thereby automatically adjusting the feed rate of the tape when required, so as to maintain said preset values during the wrapping operation.

2. A method according to claim 1, wherein the diameter of the strand entering the machine and the diameter of the armour over the strand exiting the machine are measured by means of a laser.

3. A method according to claim 1, wherein said strand of material is an electrical cable or cable core over which the armour tape is wrapped for mechanical protection thereof.

4. A system for automatically controlling tension of an armour tape being wrapped around a continuous strand of material, such as an electrical cable, travelling through an armouring machine having a reel of tape and tape feed rolls rotating around said strand and having means for controlling the speed of rotation of the tape feed rolls for thereby controlling tape feed rate, comprising: means for measuring the diameter of the strand at a point of entry to the machine; means for measuring the diameter of the armour over the strand at a point of exit from the machine; a computer responsive to the output of said measurements and to corresponding preset values stored in its memory for operating said means controlling the speed of rotation of the tape feed rolls and thereby automatically adjusting the feed rate of the tape when required, so as to maintain said preset values during operation of the machine.

5. A system according to claim 4, wherein the means for controlling the speed of rotation of the tape feed rolls comprise variable speed drives, with proportional infinitely variable transmission, P.I.V.

6. A system according to claim 4, wherein the means for controlling the speed of rotation of the tape feed rolls comprise two motors with two DC drives.

7. A system according to claim 4, wherein said means for measuring the diameter of the strand and said means for measuring the diameter of the armour over the strand are lasers.

* * * * *

UNITED STATES PATENT AND TRADEMARK OFFICE

CERTIFICATE OF CORRECTION

PATENT NO. : 5,517,812

DATED : May 21, 1996

INVENTOR(S) : Simmons

It is certified that error appears in the above-indentified patent and that said Letters Patent is hereby corrected as shown below:

The title page, should be deleted to appear as per attached title page.

The sheet of drawing, should be deleted to appear as per attached sheet.

Column 4, claim 1,line 7 replace "1. Method of" with --1. A method--.

Signed and Sealed this

Tenth Day of September, 1996

Bruce Lehman

*Attest:*

BRUCE LEHMAN

*Attesting Officer*

*Commissioner of Patents and Trademarks*

United States Patent [19]

Simmons

[11] Patent Number: 5,517,812

[45] Date of Patent: May 21, 1996

[54] AUTOMATIC CONTROL OF ARMOUR TAPE TENSION

[75] Inventor: Frederick Simmons, Fergus, Canada

[73] Assignee: Alcatel Canada Wire, Inc., Ontario, Canada

[21] Appl. No.: 342,693

[22] Filed: Nov. 21, 1994

[30] Foreign Application Priority Data

Nov. 22, 1993 [CA] Canada ..... 2109668

[51] Int. Cl.[6] ..... D02G 3/36; D02G 3/06

[52] U.S. Cl. ..... 57/18; 57/3; 57/58.83; 57/93; 57/212; 57/235; 57/264; 242/420.5; 242/441.4

[58] Field of Search ..... 57/3, 10, 11, 12, 57/18, 212, 210, 235, 264, 58.86, 58.83, 93; 242/7.22, 420, 420.5

[56] References Cited

U.S. PATENT DOCUMENTS

| | | | |
|---|---|---|---|
| 3,381,459 | 5/1968 | Vawter | 57/264 |
| 3,756,004 | 9/1973 | Gore | 57/3 |
| 4,392,342 | 7/1983 | Meijer | 57/93 |
| 4,470,248 | 9/1984 | Nortenius | 57/18 |
| 4,628,675 | 12/1986 | Sakamoto | 57/264 |
| 4,653,153 | 3/1987 | Felix et al. | 57/93 |
| 4,663,928 | 5/1987 | Delobel et al. | 57/264 |
| 4,888,944 | 12/1989 | Felix | 57/264 |
| 5,441,213 | 8/1995 | Graham | 242/534.2 |

FOREIGN PATENT DOCUMENTS

| | | | |
|---|---|---|---|
| 204281 | 8/1990 | Japan | 57/11 |

*Primary Examiner*—William Stryjewski

*Attorney, Agent, or Firm*—Ware, Fressola, Van Der Sluys & Adolphson

[57] ABSTRACT

A method and system are provided for automatically controlling tension of an armour tape being wrapped around a continuous strand of material, such as an electrical cable, travelling through an armouring machine having a reel of tape and tape feed rolls rotating around the strand and having a motor or suitable variable speed drive (such as a P.I.V. variable speed drive) for controlling the speed of rotation of the tape feed rolls and thus of tape feed rate. To achieve automatic control, the diameter of the strand entering the machine is measured, preferably by a laser, and the diameter of the armour over the strand exiting the machine is also measured, also preferably by a laser. The measurements are communicated to a computer which compares them to preset values. The computer drives the motor or variable speed drive and adjusts them when required depending on the measurements of the two diameters and so as to maintain the preset values during the wrapping operation.

7 Claims, 1 Drawing Sheet

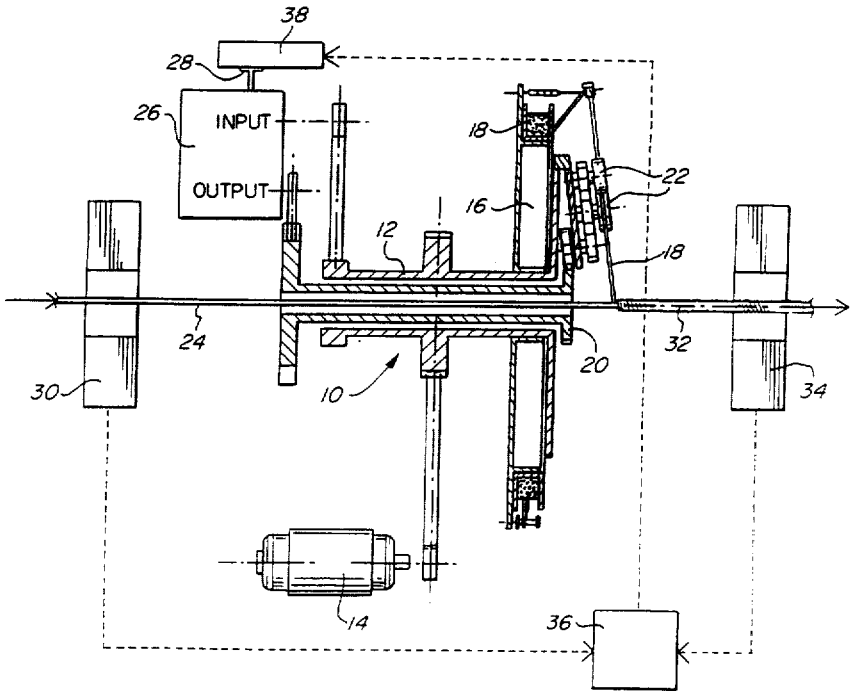

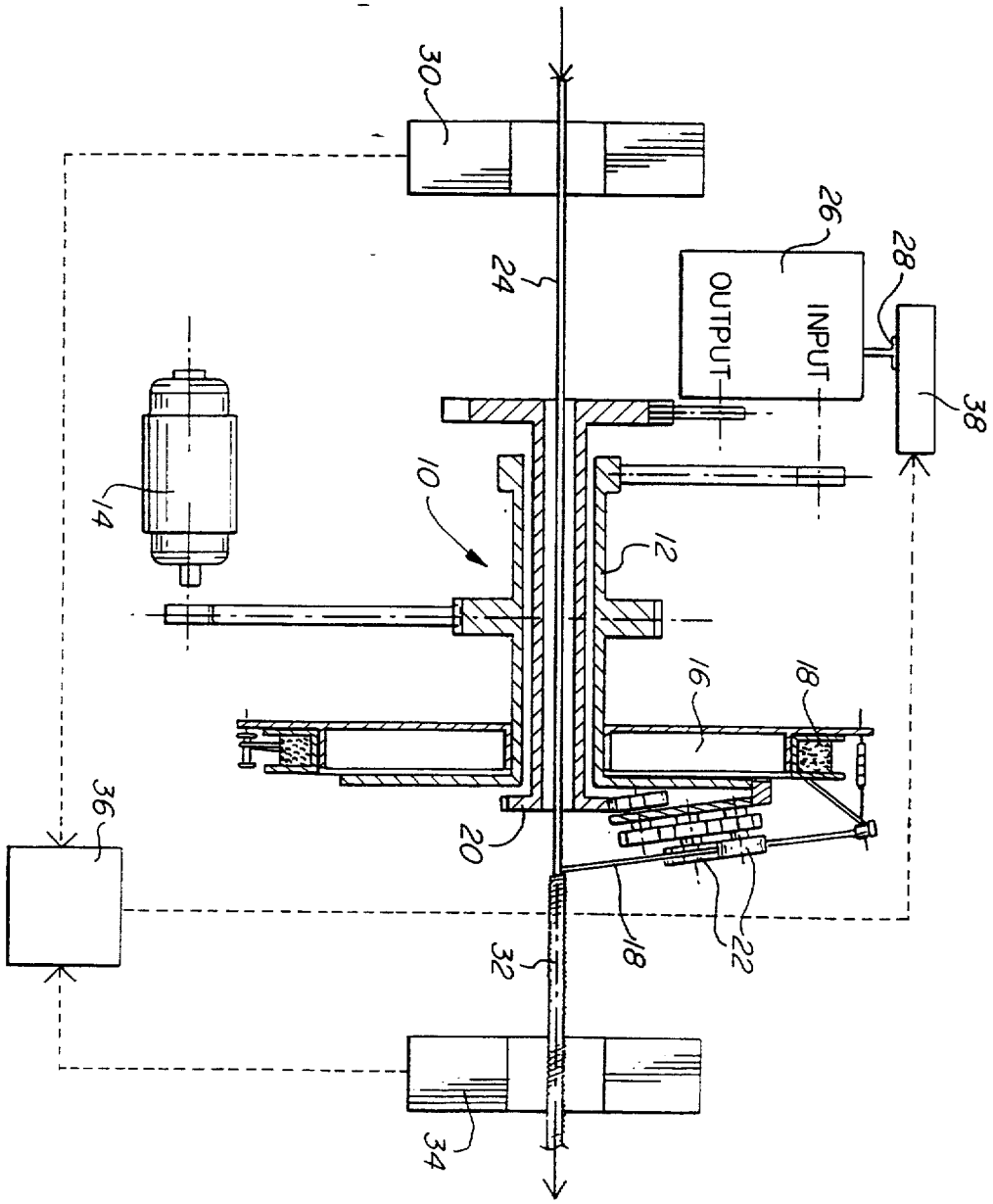
38
28
26
INPUT
OUTPUT
24
30
12
10
14
16
18
20
22
18
32
36
34